US010390683B2

(12) United States Patent
Edenius et al.

(10) Patent No.: US 10,390,683 B2
(45) Date of Patent: Aug. 27, 2019

(54) DISHWASHER

(71) Applicant: ELECTROLUX APPLIANCES AKTIEBOLAG, Stockholm (SE)

(72) Inventors: Michael Edenius, Stockholm (SE); Mats Lundberg, Stockholm (SE); Fredrik Påhlman, Stockholm (SE); Camilla Gibson, Stockholm (SE); Virgil J. Francisco, Ayden, NC (US)

(73) Assignee: Electrolux Appliances Aktiebolag, Stockholm (SE)

( * ) Notice: Subject to any disclaimer, the term of this patent is extended or adjusted under 35 U.S.C. 154(b) by 465 days.

(21) Appl. No.: 15/032,885

(22) PCT Filed: Dec. 20, 2013

(86) PCT No.: PCT/EP2013/077617
§ 371 (c)(1),
(2) Date: Apr. 28, 2016

(87) PCT Pub. No.: WO2015/090433
PCT Pub. Date: Jun. 25, 2015

(65) Prior Publication Data

US 2016/0278608 A1 Sep. 29, 2016

(51) Int. Cl.
*A47L 15/42* (2006.01)
*A47L 15/50* (2006.01)

(52) U.S. Cl.
CPC ..... *A47L 15/502* (2013.01); *A47L 15/4278* (2013.01); *A47L 15/501* (2013.01);
(Continued)

(58) Field of Classification Search
CPC .. A47L 15/502; A47L 15/4278; A47L 15/501; A47L 15/503; A47L 15/505;
(Continued)

(56) References Cited

U.S. PATENT DOCUMENTS 2,143,165 A 1/1939 Olson
2,435,807 A 2/1948 Udell
(Continued)

FOREIGN PATENT DOCUMENTS

DE 2618899 11/1977
DE 2946591 5/1981
(Continued)

OTHER PUBLICATIONS

International Search Report for corresponding International Application No. PCT/EP2013/077617, dated Sep. 11, 2014.
(Continued)

*Primary Examiner* — Michael E Barr
*Assistant Examiner* — Tinsae B Ayalew
(74) *Attorney, Agent, or Firm* — Alston & Bird LLP

(57) ABSTRACT

A dishwasher may include a basket; tubing at the bottom of the basket; at least one utensil holder rotatably connected to the tubing and rotatable between an operating positionl, in which an article can be held at the utensil holder, and a resting position, in which the utensil holder is stowed away when not in use; and a nozzle communicating with the tubing and located to direct a jet of washing liquid towards an article held at the utensil holder. The utensil holder may include a clamping portion adapted to engage an article to be cleaned, and the nozzle may be located in proximity of the clamping portion. The utensil holder may include a valve means which provides for fluid communication between the tubing and the nozzle in the operating position, and which may block the fluid communication between the tubing and the nozzle in the resting position.

20 Claims, 5 Drawing Sheets

(52) U.S. Cl.
CPC ..... *A47L 15/503* (2013.01); *A47L 15/505* (2013.01); *A47L 15/508* (2013.01)

(58) Field of Classification Search
CPC ..... A47L 15/507; A47L 15/508; A47L 15/23; A47L 15/4219; A47L 15/4259; A47L 15/4261; A47L 15/4293
USPC ..... 134/121
See application file for complete search history.

(56) References Cited

U.S. PATENT DOCUMENTS

| | | | | |
|---|---|---|---|---|
| 3,289,854 | A | 12/1966 | Kauffman | |
| 4,094,702 | A | 6/1978 | Rabuffetti | |
| 4,406,298 | A | 9/1983 | Martin | |
| 4,657,188 | A | 4/1987 | Crane et al. | |
| 4,820,351 | A | 4/1989 | Hambleton et al. | |
| 4,909,401 | A | 3/1990 | McConnell | |
| 4,927,033 | A | 5/1990 | Patera et al. | |
| 5,010,660 | A | 4/1991 | Hambleton et al. | |
| 5,450,882 | A | 9/1995 | Cragun | |
| 5,647,389 | A * | 7/1997 | Holloway | F16K 31/602 137/15.18 |
| 5,724,692 | A | 3/1998 | Zhadanov et al. | |
| 6,827,225 | B2 | 12/2004 | Miilu et al. | |
| 7,478,642 | B2 | 1/2009 | Koch et al. | |
| 7,543,712 | B2 | 6/2009 | Purushothaman | |
| 7,793,790 | B2 | 9/2010 | Lee | |
| 8,187,390 | B2 | 5/2012 | Vanderroest et al. | |
| 8,418,703 | B2 | 4/2013 | Schessl et al. | |
| 2007/0006903 | A1 | 1/2007 | Koch et al. | |
| 2011/0030742 | A1 | 2/2011 | Dalsing et al. | |
| 2011/0100505 | A1 | 5/2011 | Jendrichowski et al. | |
| 2011/0192808 | A1* | 8/2011 | Buhl | A47L 15/505 211/41.9 |
| 2012/0291827 | A1 | 11/2012 | Buddharaju et al. | |
| 2012/0306333 | A1 | 12/2012 | Eng et al. | |

FOREIGN PATENT DOCUMENTS

| | | |
|---|---|---|
| DE | 3307452 | 9/1984 |
| DE | 3330537 | 3/1985 |
| DE | 19627891 | 1/1998 |
| DE | 298 18 725 | 12/1998 |
| EP | 0997100 | 5/2000 |
| EP | 1568304 | 8/2005 |
| EP | 1 935 321 | 6/2008 |
| EP | 2 225 996 | 9/2010 |
| FR | 2544606 | 10/1984 |
| GB | 1380788 | 1/1975 |
| GB | 2260483 | 4/1993 |
| JP | 2004/305583 | 11/2004 |
| WO | WO 2004/058033 | 7/2004 |
| WO | WO 2012/065873 | 5/2012 |

OTHER PUBLICATIONS

Written Opinion of the International Search Authority for corresponding International Patent Application No. PCT/EP2013/077617, dated Jun. 20, 2016, 6 pages.

Office Action for European Patent Application No. 13 821 691.6 dated Feb. 7, 2018, 5 pages.

* cited by examiner

DISHWASHER

CROSS-REFERENCE TO RELATED APPLICATIONS

This application is a national stage application filed under 35 U.S.C. § 371 of International Application No. PCT/EP2013/077617 filed Dec. 20, 2013, which application is hereby incorporated by reference in its entirety.

FIELD OF THE INVENTION

The present application relates to a dishwasher comprising a basket for accommodating articles to be cleaned, tubing located at the bottom of the basket, said tubing being adapted for connection to a supply of washing liquid, at least one utensil holder rotatably connected to the tubing and adapted to be rotated between an operating position in which an article to be cleaned can be held at said utensil holder, and a resting position in which said utensil holder is stowed away when not in use, and a nozzle communicating with said tubing and located to direct a jet of washing liquid towards an article held at the utensil holder

BACKGROUND

Such a dishwasher is known from EP 2 225 996 A1, wherein a tubing is provided at the upper dishwasher basket which has a plurality of lateral protrusions, each protrusion being equipped with an upwardly directed nozzle. Aside each nozzle there is provided a pin shaped utensil holder protruding upwards in the dishwasher basket and having a round head at its outer end. The pin shaped utensil holders are intended for the placement of hollow articles to be cleaned, such as baby bottles. While in one embodiment, a rotary knob is provided at the outer end of the tubing for the user to turn on or off the water supply to the nozzles, in alternative embodiments there is provided a valve upstream the nozzles so as to selectively turn on or off the water supply to the nozzles.

While the dishwasher shown in EP 2 225 996 A1 can improve the washing result for articles placed over the pin shaped utensil holders, it also has certain disadvantages. In particular, since an article placed over one of the pin shaped utensil holders may move during a washing cycle, it cannot be guaranteed that the water jet ejected from the respective nozzle reaches the interior of the article. Thus, particularly when the article is a hollow vessel having a small opening, such as a bottle, already a minute movement of the bottle neck may result in a poor cleaning for such article. Furthermore, since in the dishwasher known from EP 2 225 996 A1 the means for turning on or off the water supply to the nozzles acts on the common water supply to all the nozzles, in case that in a washing cycle not all the utensil holders are used, the washing liquid ejected from the nozzles associated to the not used utensil holders is wasted.

SUMMARY OF VARIOUS EMBODIMENTS

It is an object of the present invention to provide for a dishwasher of the above mentioned type which provides for an improved comfort of use, and particularly for a greater flexibility in use and for a better cleaning result.

In a dishwasher of the above mentioned type this object is solved in that the utensil holder comprises a clamping portion adapted to engage an article to be cleaned, wherein the said nozzle is located in proximity of the clamping portion; and in that the utensil holder comprises a valve means which provides for fluid communication between the tubing and the nozzle when the utensil holder is in the operating position, and which blocks the fluid communication between the tubing and the nozzle when the utensil holder is in the resting position.

By providing for a clamping portion at the utensil holder, an article to be cleaned can be attached at the utensil holder in a predetermined stable orientation. This, in combination with the feature that the nozzle is located in proximity of the clamping portion, ensures that the jet of washing liquid ejected from the nozzle is directed, and during the washing cycle remains directed, as intended towards the article attached at the utensil holder. Furthermore, since each utensil holder comprises a valve means which in dependency on the position of the utensil holder opens or blocks the fluid communication between the tubing and the nozzle, the user has the ability to select how many of the utensil washing sites are to be activated or disabled during a washing cycle simply rotating the respective utensil holders into its operating position or its resting position.

Preferred embodiments of the present invention are defined in the dependent claims.

In particular, the valve means can be formed in that the tubing has an outlet for washing liquid, and the utensil holder has a sealing surface which selectively blocks or releases said outlet in dependency of the rotary position of the utensil holder. The valve means thus can be formed by providing for a suitable shaping of the tubing and the utensil holder, which thus can be implemented in a particularly cost-efficient manner when designing the tubing and/or the utensil holder as molded plastic components.

In such latter embodiments the utensil holder can have a mounting portion which has the shape of a cylinder segment and which comprises said sealing surface, wherein a feed orifice is provided within the sealing surface, which feed orifice communicates with the nozzle and is arranged such that it coincides with the outlet when the utensil holder is in the operating position. In order to provide for a snap-on connection of the utensil holder to the tubing, the mounting portion preferably has the shape of a cylinder segment which spans an angular range of 200° to 280°, so that it securely embraces the tubing. In such embodiments, the mounting of the utensil holder can be facilitated by providing ramping surfaces at the tubing and/or the mounting portion of the utensil holder, which ramping surfaces assist the spreading of the mounting portion in providing for the for the snap-on connection.

In preferred embodiments the utensil holder comprises a rigid first post and a flexible second post extending generally in parallel to the first post, wherein the first and the second post cooperate to constitute the clamping portion of the utensil holder. In such embodiments the nozzle preferably is provided at the free end of the rigid first post, wherein a nozzle feed channel extends through the first post and communicates with the nozzle. When in such an embodiment an article to be cleaned, such as a bottle, is held at the utensil holder, the nozzle will be arranged at a location within the bottle. Thus it is effectively avoided that during the washing cycle the article can move into a position where the spray jet ejected from the nozzle no longer is directed to the interior of the article.

In order to facilitate flexing of the second post, the second post preferably comprises a tab which laterally protrudes from the post, and which tab thus forms a grip portion for a user to flex the second post so as to facilitate the attachment of an article to be cleaned to the utensil holder. To avoid slipping when depressing the tab, the tab, at least in the portion forming a grip portion, can be provided with a surface roughening or a slip-resistant coating.

In preferred embodiments the utensil holder comprises a thread at the first and/or the second post, so as to allow for a threaded connection with an article to be cleaned, such as a drinking bottle or a jar having a screw cap. With the nozzle being provided at the rigid first post, for attachment of containers having an outer thread, such as baby bottles or jam jars, the flexible second post is provided with a thread, which can be formed by a groove in the surface of the post, or by rims projecting from the surface of the post.

Preferably there is provided a latching means adapted to secure the rotational position of the utensil holder art least in the operating position, and optionally also in the resting position. Such latching means can comprise a rotational stop or a clamp acting between the utensil holder and the tubing or between the utensil holder and a bar of the basket. Alternatively or additionally the latching means can comprise an arrangement comprising a projection and a cooperating depression, one of which is provided at the utensil holder and the other one of which is provided at the tubing.

While the tubing which supports and feeds the utensil holders can be provided anywhere at the basket, in a preferred embodiment the tubing is part of or connects to a feed tube for feeding washing liquid to a spray arm that is mounted at the bottom of the basket. This obviates the need to provide for a separate additional feed line for feeding washing liquid to the tubing. In this manner a dishwasher as recited in claim 1 can be implemented also by retrofitting a conventional dishwasher, by replacing the feed tube for the spray arm by a feed tube having an additional connection to the tubing.

The flexibility of use of the dishwasher can be further enhanced by providing for a plurality of different utensil holders which can be selectively interchanged by the user, so as to adapt the dishwasher for accommodation of different articles to be held by the utensil holders. Furthermore, by mounting an utensil holder having an orifice which acts as spray nozzle when the utensil holder is in the resting position, there can be provided for an additional stationary spray nozzle, which can be of particular advantage if such utensil holder is located in a region of the basket that is difficult to reach by the jets from the rotating spray arm.

In order to allow for a secure fixing of the tubing at the basket there can be provided a fixing means having a plurality of clamps which engage bars of the basket. Preferably such fixing means comprises a molded plastic part, which allows to integrally form clamping regions and thus minimizes the number of parts to be assembled. Furthermore, when implementing the fixing means, the tubing and or the utensil holders as molded plastic components, it is possible to provide any such components with semiotic surfaces, i.e. with surfaces in which there are formed instructional signs for a user, such as symbols or text, which are integrally formed when molding component.

BRIEF DESCRIPTION OF THE SEVERAL VIEWS OF THE DRAWINGS

Preferred embodiments of the present invention are described by reference to the drawings, in which.

DETAILED DESCRIPTION

Figure 1:
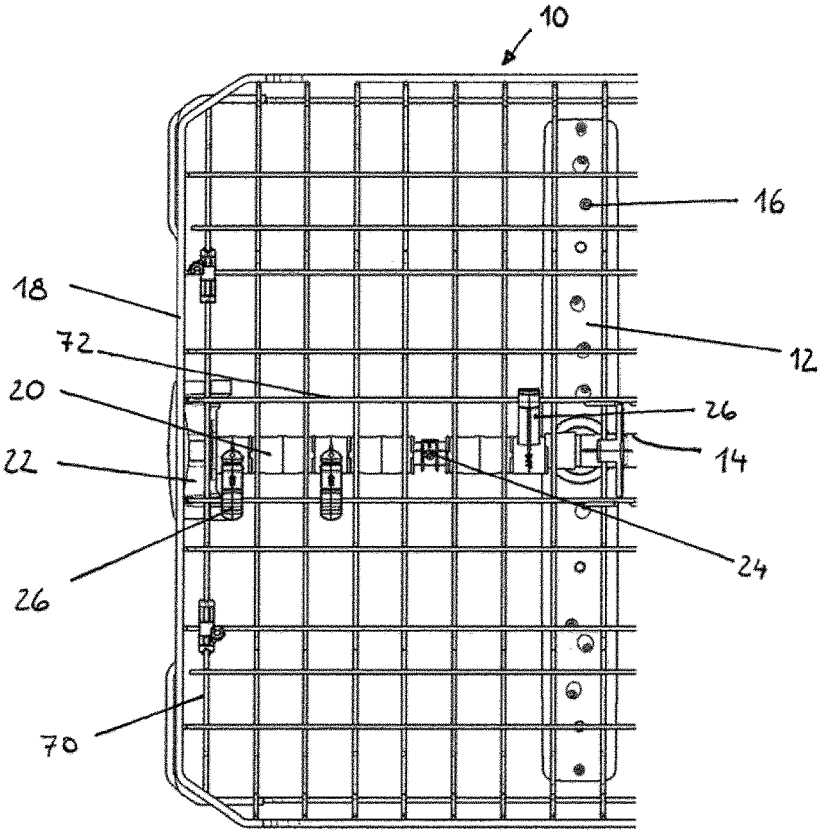
FIG. 1 shows a basket of a dishwasher in accordance with the present invention, wherein a plurality of utensil holders is shown is different states of use.

In FIG. 1 there is shown a basket 10 of a dishwasher made in accordance with the present invention. Basket 10 may comprise the upper basket of a dishwasher having also a lower basket, wherein the baskets are provided within a washing chamber to which cleaning liquid, such as water to which detergent is added during the washing cycle, is sprayed onto the articles to be cleaned by means of a plurality of rotating spay arms, such as a lower spay arm that is located in the sump of the washing chamber and an upper spay arm which is located at the bottom side of the upper basket.

Basket 10 shown in FIG. 1 thus may comprise an upper basket of a dishwasher having two baskets, wherein a spray arm 12 is rotatably supported at the bottom of the basket. Spray arm 12 is supplied with cleaning liquid via a feed tube 14, only the end of which terminating at the spray arm is shown in FIG. 1. When basket 10 is in a position for conducting a washing cycle, feed tube 14 connects to a feed line at the rear wall of the washing chamber, which in the view of FIG. 1 would be at the right of basket 10. Spray arm 12 comprises a plurality of spaying nozzles 16 to direct jets of washing fluid towards articles to be placed within the basket. Towards the front end 18 of basket 10 there is provided at the bottom side of basket 10 a tubing 20 which is secured to the basket by means of a fixing portion 22 which will be explained in further detail by reference to FIGS. 4 and 8. In the embodiment shown in FIG. 1 tubing 20 is designed as an extension of feed tube 14 towards the front end 18 of basket 10. It is to be understood, that tubing 20, or an additional such tubing, could also be arranged laterally offset from the center of basket 10, or in any other desired location or orientation with respect to the basket. Also, it of course would be possible to provide for a tubing 20 as it is shown in FIG. 1 in the rear part of the basket 10, i.e. as a replacement of feed tube 14.

Figure 4:
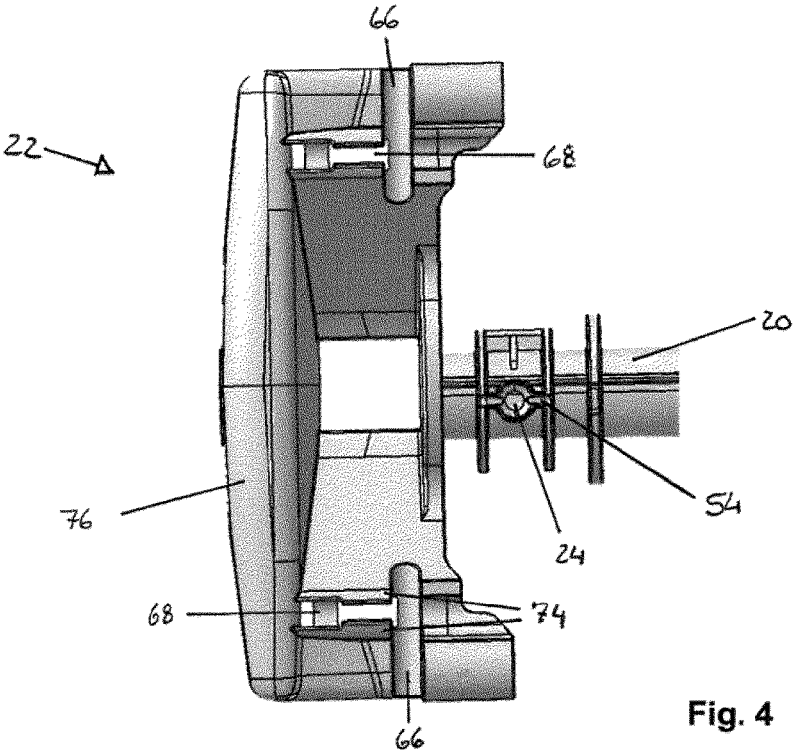
FIG. 4 is a top view of the front section of the tubing shown in FIG. 1.

Tubing 20 is provided with a plurality of outlets 24, which are shown in greater detail in FIG. 4. In the embodiment shown in FIG. 1, tubing 20 supports four utensil holders 26 of which the left two are shown in FIG. 1 in an operating position, the one towards the right is shown in a resting position and, for purposes of illustration, the third one has been omitted so as to expose outlet 24 of tubing 20.

Figure 2:
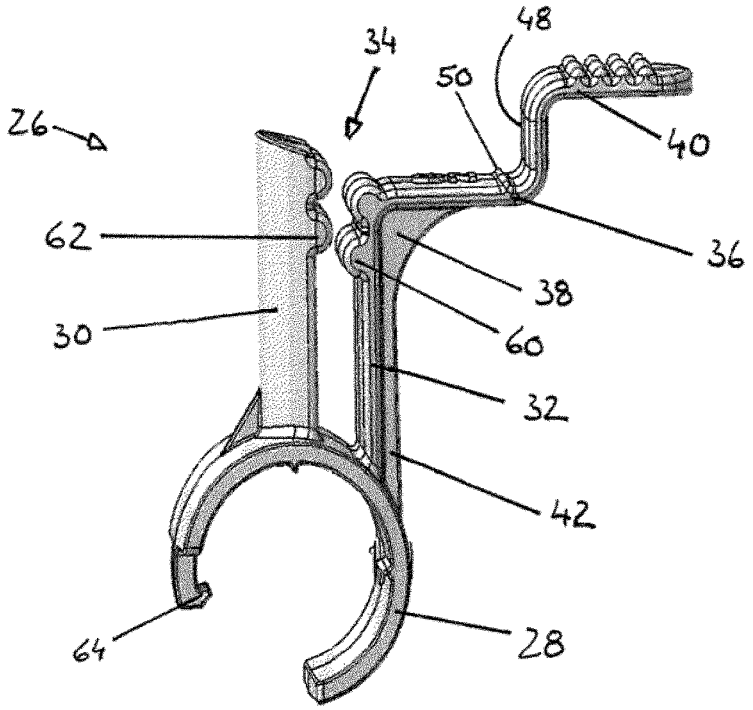
FIG. 2 is a perspective side view of one of the utensil holders shown in FIG. 1.
Figure 3:
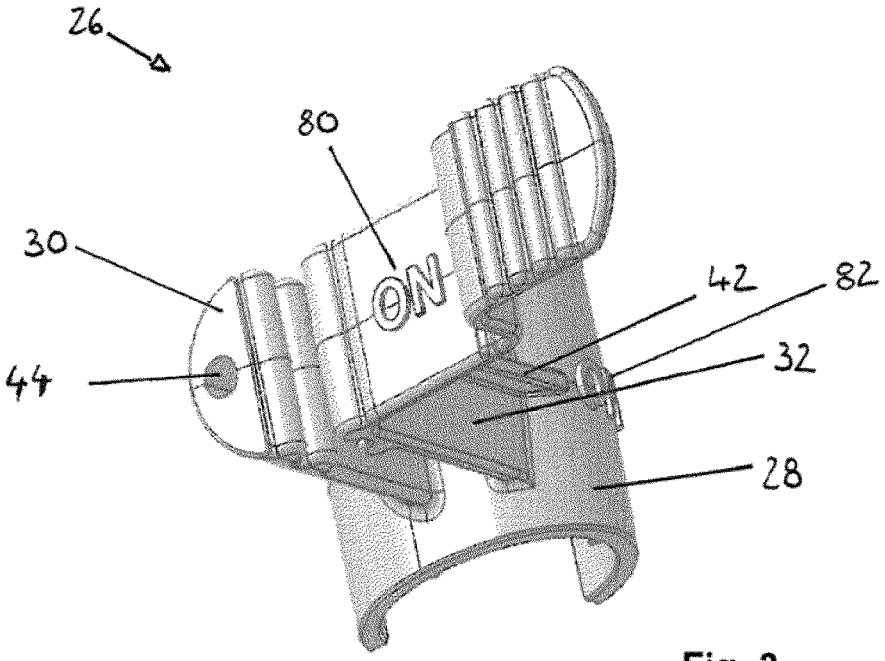
FIG. 3 is a perspective view of the utensil holder shown in FIG. 2 when viewed from a different angle.
Figure 5:
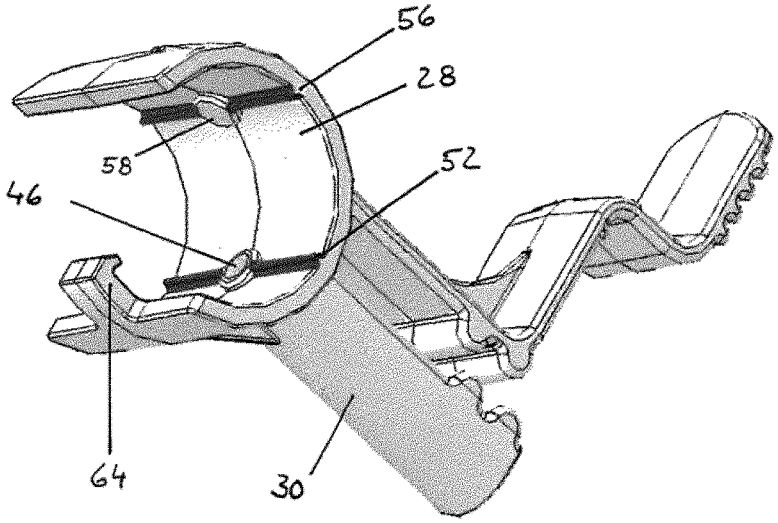
FIG. 5 is a perspective view of the utensil holder shown in FIGS. 2 and 3 when viewed from still a different angle.
Figure 6:
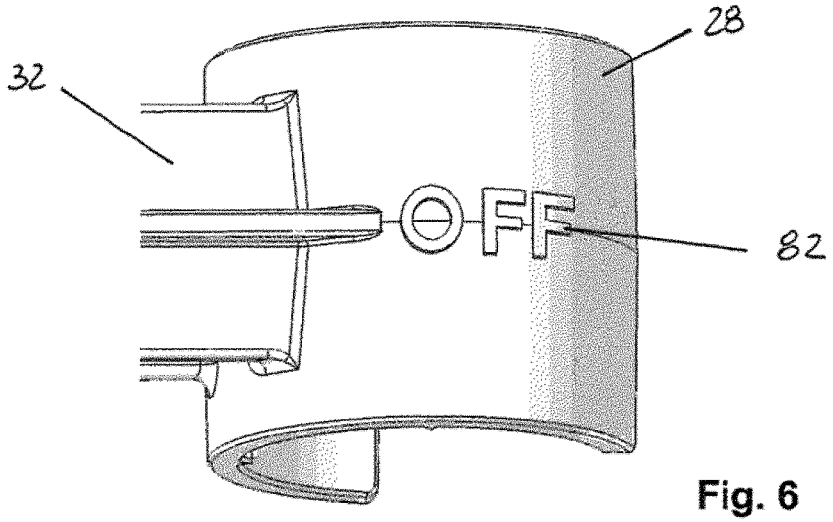
FIGS. 6 and 7 are partial views of two variants of an utensil holders shown in FIG. 1.

As can be seen particularly from FIGS. 2, 3 and 5 which show utensil holder 26 in greater detail, the utensil holder 26, which preferably is designed as a molded plastic part, comprises a mounting portion 28 which in the embodiments shown in the figures has the shape of a cylinder segment. Thus, by choosing for the utensil holder 26 a material which has a certain flexibility, utensil holder 26 can be mounted onto tubing 20 by temporarily deforming the mounting portion 28, so that it snaps onto tubing 20.

Utensil holder 26 further comprises a rigid first post 30 and a flexible second post 32, which extends generally in parallel to first post 30 so as to form a clamping portion 34 between the first post 30 and the second post 32. Advantageously the flexible second post 32 comprises a tab 36 which facilitates flexing the second post so as to insert an article to be cleaned into the clamping portion 34. As shown in FIGS. 2 and 5, the flexible second post can comprise a stiffening section 38 supporting tab 36 so as to provide for an outward flexing of the second post when tab 36 is depressed, rather than for a flexing of the tab 36 as such. Tab 36 further can comprise a stepped portion 40 which engages a bar of the basket 10 when utensil holder 26 is in the resting position as it is shown for the utensil holder 26 in the right portion of FIG. 1. The flexibility of the second post can be adapted as needed by providing a reinforcing rib 42 which extends along the second post 32.

As is shown in FIG. 3, a nozzle 44 is provided at the free end of the rigid first post 30 which nozzle communicates, via a nozzle feed channel extending through the first post, with an inlet orifice 46 which opens at the interior side of mounting portion 28 (see FIG. 5). When utensil holder 26 is in its operating position as is indicated for the left two utensil holders 26 in FIG. 1, and wherein the utensil holder 26 is oriented in an upright position as it is shown in FIG. 2, the inlet orifice 46 is aligned to outlet 24 of tubing 20 so that the nozzle 44 is in fluid communication with the supply of washing liquid provided via feed tube 14. When the utensil holder 26 is not to be used, it can be rotated from the orientation shown in FIG. 2 by 90° in the counterclockwise direction, so that portion 48 of the stepped portion 40 of tab 46 (see FIG. 2) rests on an adjacent bar 72 of the basket 10 (see FIG. 1). Utensil holder 26 is secured in this position by means of a latching rim 50 provided at tab 36, which by corporation with section 48 of tab 36 clamps onto bar 72 of basket 10.

In order to arrest the utensil holder 26 in its upright operating position, there is provided at the interior side of the mounting portion 28 a latching rim 52 which is positioned to be in alignment with the inlet orifice 46. When the utensil holder 26 is in its operating position, the latching rim 52 snaps into a corresponding latching groove 54 (see FIG. 4) provided at tubing 20 in alignment with the outlet 24. As shown in FIG. 5, a similar latching rim 56 is provided at the interior side of mounting portion 28 in a position about 90° offset to inlet orifice 46 so as to arrest utensil holder 26 and at the same time seal outlet 24 when the utensil holder 26 is in its resting position. As is illustrated in FIG. 5 there can be provided a sealing surface 58 to seal outlet 24 in the resting position of the utensil holder 26.

Figure 9:
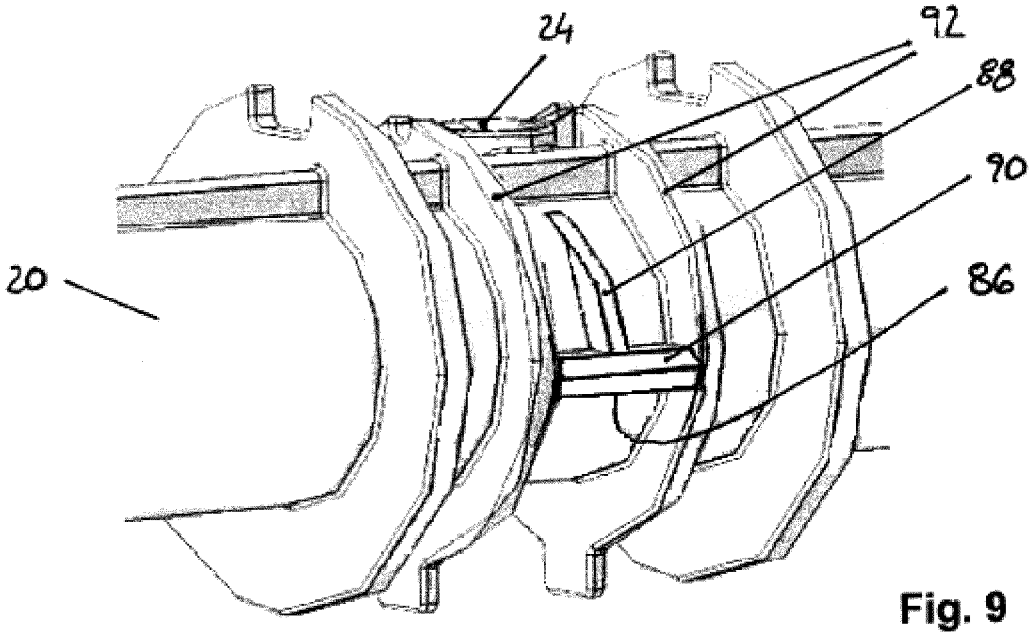
FIG. 9 is a perspective side view of the tubing shown in FIG. 4.

As can be seen particularly in FIGS. 2 and 5, to assist fixing the utensil holder 26 in its upright operating position there further is provided a rotational stop 64 which, when utensil holder 26 is in its upright operating position, engages a respective stop 86 provided at tubing 20 (see FIG. 9).

In order to provide for particularly stable attachment of threaded articles to utensil holder 26, such as drinking bottles, baby bottles or threaded jars, the utensil holder can be provided with inner or outer threads at one or both of posts 30 and 32. Thus, in order to engage an article having an outer thread, such as it is common for baby bottles, the flexible second post 32 can comprise rims 60 which thus form a threaded groove between them. Additionally or alternatively, in order to allow for a threaded connection with an article having an inner thread, such as is often seen in drinking bottles for use in sports, there can be provided respective rims 62 at the rigid post 30.

Figure 8:
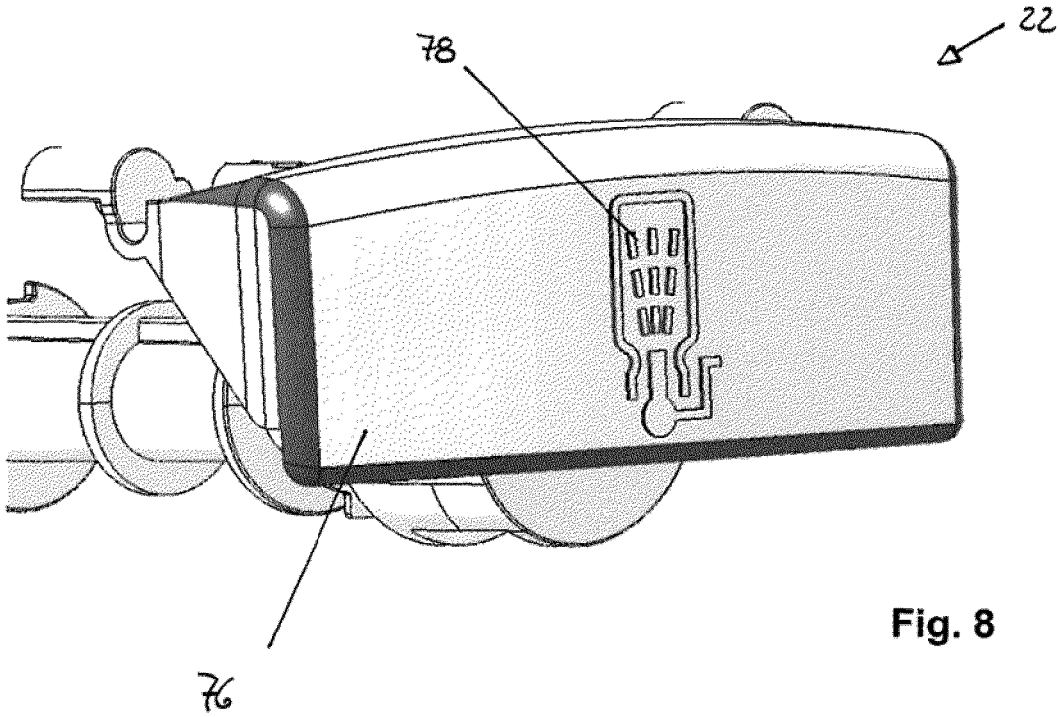
FIG. 8 is a perspective front view of the front section of the tubing shown in FIG. 4.

Tubing 20 is fixedly attached to the basket 10 by means of a fixing portion 22 which is shown in further detail in FIGS. 4 and 8. In the embodiment shown in the figures, fixing portion 22 is a molded plastic part which at least in part is formed integrally with tubing 20. Fixing portion 22 comprises at its upper side a plurality of grooves 66, 68 where the fixing portion rests against the bottom side of the basket. Thus, as shown in FIGS. 4 and 1, a cross bar 70 of basket 10 can be accommodated in grooves 66, and a longitudinal bar 72 can be accommodated within grooves 68.

In order to provide for a fixing of the bars within the grooves 66, 68 of the fixing portion 22, these grooves can be provided with respective clamping walls 74 which partially embrace the respective bar of the basket. In the embodiment shown in the drawings the fixing portion 22 comprises a front portion 76, which provides for further stability of the fixing portion and which at the same time can be used as instruction panel for the user, such as by providing text or symbols at the front side where the front portion is visible to the user. Particularly when the fixing portion is a molded plastic part, such instructions for a user can be provided by molding respective symbols or text into the front portion 76 of the fixing portion 22. Thus, as is shown in FIG. 8, front portion 76 of fixing portion 22 can be provided with a semiotic surface 78 which is provided as an elevation or depression within the front wall of front portion 76.

As is illustrated particularly in FIG. 3, also the utensil holders 26 can be provided with semiotic surfaces providing instructions to a user, such as a labeling "ON" 80 that is provided at the upper side of tab 36 and the labeling "OFF" 82 that is provided in the cylinder segment of the mounting portion, which labelings 80 and 82 facilitate the use of the utensil holder by indicating to the user how to position the same to be in the operation position or the resting position.

Figure 7:
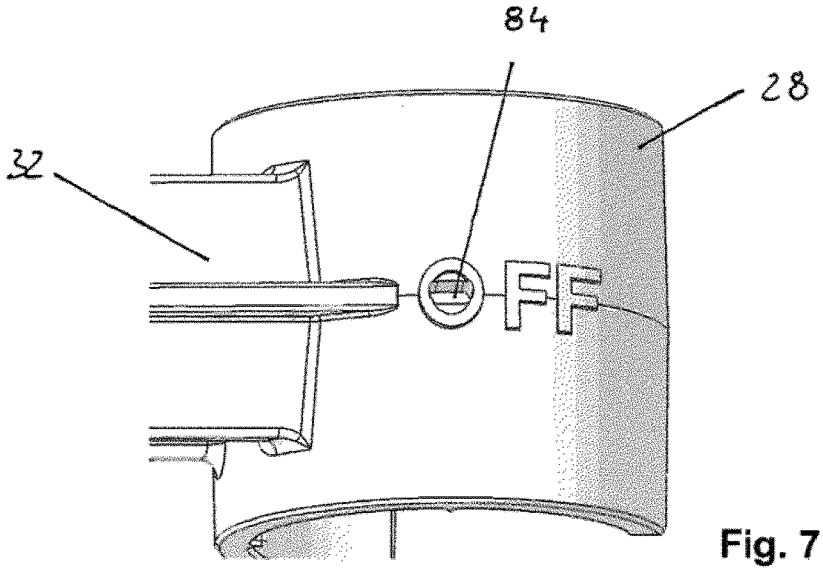

As mentioned above, there can be provided different types of utensil holders which can be selectively mounted on tubing 20, so that the user can easily adapt the dishwasher to accommodate for the secure placement of different articles within the basket. While such utensil holders may differ for example in the height of posts 30 and 32, in the width of the clamping portion 34, in the provision of rims 60 and 62 for providing for a threaded connection with the articles to be held, in the number and placement of nozzles 44 provided at the first post 30, and the like, the utensil holder 26 further can be provided with an orifice 84 (see FIG. 7) which acts as a spay nozzle when the utensil holder 26 is positioned in the resting position. Such an embodiment can be particularly useful when the tubing 20 is arranged to in a region of the basket 10 which is difficult to be reached by jets from the spray arm 12, such as in the corner regions of the basket.

In case that the dishwasher comprises more utensil holders than required by the user, individual of the utensil holders also may be replaced by a cover which seals the outlet 24 of the tubing 20. Thus, in order to replace the utensil holder 26 shown in FIG. 2 by a cover, a segmented cylindrical cover element can be provided which basically corresponds to only the mounting portion 28 of utensil holder 26 wherein the posts 30 and 32 are omitted and which has no inlet orifice 46.

To facilitate mounting of an utensil holder 26 at the tubing 20, during which as mentioned above the mounting portion 28 of the utensil holder is temporarily deformed so that it snaps onto the tubing, tubing 20 can be provided with features which assist the spreading of the segmented cylindrical shape of the mounting portion 28.

In particular, as is shown in FIG. 9, tubing 20 can be provided with a radial ramping rib 88 and an axial ramping rib 90 which are molded on the side of the tubing 20 so as to form a T-shape. When mounting the utensil holder 26 onto the tubing 20, the utensil holder 26 is set onto the tubing such that the stop 64 rests on the radial ramping rib 88. As the mounting portion 28 is pressed or twisted onto the tubing, such as by setting the non-hooked curved portion (i.e. the right end of mounting portion 28 as shown in FIG. 2) on the tubing 20 and then twisting or rotating the utensil holder 26 about the tubing toward the hook-shaped stop 64, stop 64 slides along the radial ramping rib 88 and further along the axial ramping rib 90 thus biasing the mounting portion 28 outwardly, wherein the chamfer on the end of the hook-shaped stop 64 similarly acts as a cam surface to facilitate the cam action between the stop and the ramping surfaces. When stop 64 passes over the lower end of axial rib 90, it snaps over rib 90, thus securing utensil holder 26 at the tubing 20. In the mounted state of the utensil holder, the interior surface of the cylindrical mounting portion 28 rests on annular ribs 92 provided circumferentially at the tubing 20, wherein the bottom side of rib 90 forms stop 86 which limits rotation of utensil holder 26 about tubing 20.

LIST OF REFERENCE SIGNS

10 basket
12 spray arm
14 feed tube
16 spraying nozzle
18 front end of 10
20 tubing
22 fixing portion
24 outlet
26 utensil holder
28 mounting portion of 26
30 first post
32 second post
34 clamping portion
36 tab
38 stiffening section
40 stepped portion
42 reinforcing rib
44 nozzle
46 inlet orifice
48 portion of tab
50 latching rim
52 latching rim
54 latching groove
56 latching rim
58 sealing surface
60 rim at 32 for threaded connection
62 rim at 30 for threaded connection
64 stop
66, 68 grooves
70 cross bar
72 longitudinal bar
74 clamping wall
76 front portion
78 semiotic surface
80 labeling "ON"
82 labeling "OFF"
84 spray nozzle
86 stop at 20
88 radial ramping rib
90 axial ramping rib
92 annular ribs

The invention claimed is:

1. A dishwasher comprising:

(a) a basket for accommodating articles to be cleaned;

(b) tubing located at the bottom of the basket, said tubing being adapted for connection to a supply of washing liquid;

(c) a plurality of utensil holders independently rotatably connected to the tubing, each of said plurality of utensil holders being adapted to be rotated between an operating position in which an article to be cleaned can be held at said utensil holder, and a resting position in which said utensil holder is configured to be stowed away, wherein the plurality of utensil holders are each independently rotatable relative to each other; and (d) a plurality of nozzles configured to communicate with said tubing and located to direct a jet of washing liquid towards an article held at the utensil holder;

wherein each utensil holder comprises a clamping portion adapted to engage an article to be cleaned, wherein said nozzle is located in proximity of the clamping portion; and wherein each utensil holder comprises a valve which provides for fluid communication between the tubing and a respective one of the plurality of nozzles when the respective utensil holder rotated into the operating position, and which blocks the fluid communication between the tubing and the respective one of the plurality of nozzles when the respective utensil holder is rotated into the resting position.

2. The dishwasher of claim 1, wherein each of said valve is formed in that said tubing has an outlet for washing liquid; and said each utensil holder has a sealing surface which selectively blocks or releases said outlet in dependency of the rotary position of the utensil holder.

3. The dishwasher of claim 2, wherein said each utensil holder has a mounting portion having the shape of a cylinder segment and comprising said sealing surface, wherein a feed orifice is provided within said sealing surface, said feed orifice communicating with said nozzle and being arranged such that it coincides with said outlet when the utensil holder is in the operating position.

4. The dishwasher of claim 3, wherein said mounting portion has the shape of a cylinder segment which spans an angular range of 200° to 280°.

5. The dishwasher of claim 1, wherein said each utensil holder comprises a rigid first post and a flexible second post extending generally in parallel to the first post, the first and the second post cooperating to constitute the clamping portion of said utensil holder.

6. The dishwasher of claim 5, wherein each of said plurality of nozzles is provided at the free end of the first post, wherein a nozzle feed channel extends through the first post and communicates with each nozzle.

7. The dishwasher of claim 5, wherein said flexible second post comprises a tab which laterally protrudes from the post.

8. The dishwasher of claim 5, comprising at least one thread at the first post and/or the second post for engagement with an article to be cleaned.

9. The dishwasher of claim 1, comprising latching means adapted to secure the rotational position of the utensil holder in the operating position and/or the resting position.

10. The dishwasher of claim 9, wherein said latching means comprises a projection and a cooperating depression provided at the utensil holder and the tubing.

11. The dishwasher of claim 9, wherein said latching means comprises a latching projection or groove provided at the utensil holder and adapted to engage a bar of the basket.

12. The dishwasher of claim 7, wherein said tab has a stepped shape adapted to secure the rotational position of the utensil holder by engagement with a bar of the basket.

13. The dishwasher of claim 1, comprising a spray arm mounted at the bottom of the basket, wherein said tubing is part of or connects to a feed tube for feeding washing liquid to said spray arm.

14. The dishwasher of claim 1, comprising a plurality of different utensil holders adapted to be selectively interchanged by the user.

15. The dishwasher of claim 1, wherein each valve of each utensil holder is configured to independently communicate the tubing and the respective one of the plurality of nozzles when the respective utensil holder rotated into the operating position, and independently block the fluid communication between the tubing and the respective one of the plurality of nozzles when the respective utensil holder is rotated into the resting position.

16. The dishwasher of claim 1, further comprising a second nozzle configured to communicate with the tubing and located to direct a second jet of washing liquid towards an article in the basket, wherein the valve is configured to provide fluid communication between the tubing and the second nozzle when the utensil holder is in the resting position and to block the fluid communication between the tubing and the second nozzle when the utensil holder is in the operating position.

17. The dishwasher of claim 1, wherein the plurality of utensil holders are independently attached to the tubing and independently rotatable relative to the tubing about an axis of the tubing, such that each of the plurality of the utensil holders is configured to independently engage the tubing and independently rotate between the operating position and the resting position to control the fluid communication to the respective one of the plurality of nozzles.

18. The dishwasher of claim 1, wherein the valve comprises a sealing surface and an inlet orifice formed in the utensil holder, wherein the tubing comprises a plurality of outlet openings, wherein each of the plurality of utensil holders is disposed at an axial position of a respective one of the plurality of outlet openings, and wherein each utensil holder is configured to independently rotate about an axis of the tubing between the operating position and the resting position to cause the sealing surface of the valve to align with the respective one of the plurality of outlet openings in the resting position and to cause the inlet orifice to align with the respective one of the plurality of outlet openings in the operating position.

19. A dishwasher comprising:

(a) a basket for accommodating articles to be cleaned;

(b) tubing located at the bottom of the basket, said tubing being adapted for connection to a supply of washing liquid;

(c) at least one utensil holder rotatably connected to the tubing and adapted to be rotated between an operating position in which an article to be cleaned can be held at said utensil holder, and a resting position in which said utensil holder is configured to be stowed away; and (d) a nozzle communicating with said tubing and located to direct a jet of washing liquid towards an article held at the utensil holder;

wherein said utensil holder comprises a clamping portion adapted to engage an article to be cleaned, wherein said nozzle is located in proximity of the clamping portion;

wherein said utensil holder comprises a valve which provides for fluid communication between the tubing and the nozzle when the utensil holder is in the operating position, and which blocks the fluid communication between the tubing and the nozzle when the utensil holder is in the resting position;

wherein said utensil holder comprises a first post and a second post extending generally in parallel to the first post, the first and the second post cooperating to constitute the clamping portion of said utensil holder; and (e) at least one thread at the first post and/or the second post for engagement with an article to be cleaned.

20. A dishwasher comprising:

(a) a basket for accommodating articles to be cleaned;

(b) tubing located at the bottom of the basket, said tubing being adapted for connection to a supply of washing liquid;

(c) at least one utensil holder rotatably connected to the tubing and adapted to be rotated between an operating position in which an article to be cleaned can be held at said utensil holder, and a resting position in which said utensil holder is configured to be stowed away; and (d) a nozzle communicating with said tubing and located to direct a jet of washing liquid towards an article held at the utensil holder;

wherein said utensil holder comprises a clamping portion adapted to engage an article to be cleaned, wherein said nozzle is located in proximity of the clamping portion;

wherein said utensil holder comprises a valve which provides for fluid communication between the tubing and the nozzle when the utensil holder is in the operating position, and which blocks the fluid communication between the tubing and the nozzle when the utensil holder is in the resting position;

wherein said utensil holder comprises a first post and a second post extending generally in parallel to the first post, the first and the second post cooperating to constitute the clamping portion of said utensil holder; and wherein at least one of said first post and said second post comprises a tab which laterally protrudes from the post; and wherein said tab has a stepped shape adapted to secure the rotational position of the utensil holder by engagement with a bar of the basket.

* * * * *